US006712000B1

(12) United States Patent
Holm et al.

(10) Patent No.: US 6,712,000 B1
(45) Date of Patent: Mar. 30, 2004

(54) ARRANGEMENT OF BEARINGS PERTAINING TO A CYLINDER OF A ROTARY PRINTING PRESS

(75) Inventors: Helmut Holm, Erlabrunn (DE); Kurt Johannes Weschenfelder, Zell/Main (DE); Thomas Gerhard, Retzstadt (DE)

(73) Assignee: Koenig & Bauer Aktiengesellschaft, Wurzburg (DE)

( * ) Notice: Subject to any disclaimer, the term of this patent is extended or adjusted under 35 U.S.C. 154(b) by 30 days.

(21) Appl. No.: 10/130,274

(22) PCT Filed: Nov. 23, 2000

(86) PCT No.: PCT/DE00/04154

§ 371 (c)(1),
(2), (4) Date: May 28, 2002

(87) PCT Pub. No.: WO01/38093

PCT Pub. Date: May 31, 2001

(30) Foreign Application Priority Data

Nov. 26, 1999 (DE) ..... 199 56 949

(51) Int. Cl.[7] ..... B41F 5/00; B41F 13/20

(52) U.S. Cl. ..... 101/216; 101/219; 101/348; 101/181; 384/256

(58) Field of Search ..... 101/216, 219, 101/348, 181–184; 384/256

(56) References Cited

U.S. PATENT DOCUMENTS

| | | | |
|---|---|---|---|
| 2,986,997 | A | 6/1961 | Schmutz |
| 3,424,084 | A | 1/1969 | Chambon |
| 3,786,749 | A | 1/1974 | Vir Singh |
| 4,362,089 | A | 12/1982 | Melocik et al. |
| 4,932,321 | A | 6/1990 | Hermach |
| 5,092,240 | A | 3/1992 | Schumacher |
| 5,458,061 | A | 10/1995 | Koura et al. |
| 5,630,364 | A | 5/1997 | Koura et al. |
| 5,644,982 | A | 7/1997 | Koura et al. |
| 5,647,275 | A | 7/1997 | Lupa et al. |
| 5,683,202 | A | 11/1997 | Hummel et al. |
| 5,813,336 | A | 9/1998 | Guaraldi et al. |
| 6,109,180 | A | 8/2000 | Guaraldi et al. |

FOREIGN PATENT DOCUMENTS

| | | |
|---|---|---|
| DE | 1 561 048 | 2/1970 |
| DE | 1 611 270 | 3/1972 |
| DE | 43 14 082 A1 | 11/1994 |
| DE | 44 23 803 A1 | 1/1996 |
| DE | 196 46 135 A1 | 6/1997 |
| EP | 0 714 767 A1 | 6/1996 |
| EP | 0 734 857 A2 | 10/1996 |
| EP | 0 714 767 B1 | 5/1998 |
| EP | 0 878 299 A1 | 11/1998 |

*Primary Examiner*—Charles H. Nolen, Jr.
*Assistant Examiner*—Marissa Ferguson
(74) *Attorney, Agent, or Firm*—Jones, Tullar & Cooper, PC

(57) ABSTRACT

A cylinder for a rotary printing press is supported by bearings that are situated outside of the spaced side frames of the press. Each bearing is arranged in a bearing bushing that is, in turn supported by the press lateral frame. All of the bearing is located away from the lateral frame.

16 Claims, 1 Drawing Sheet

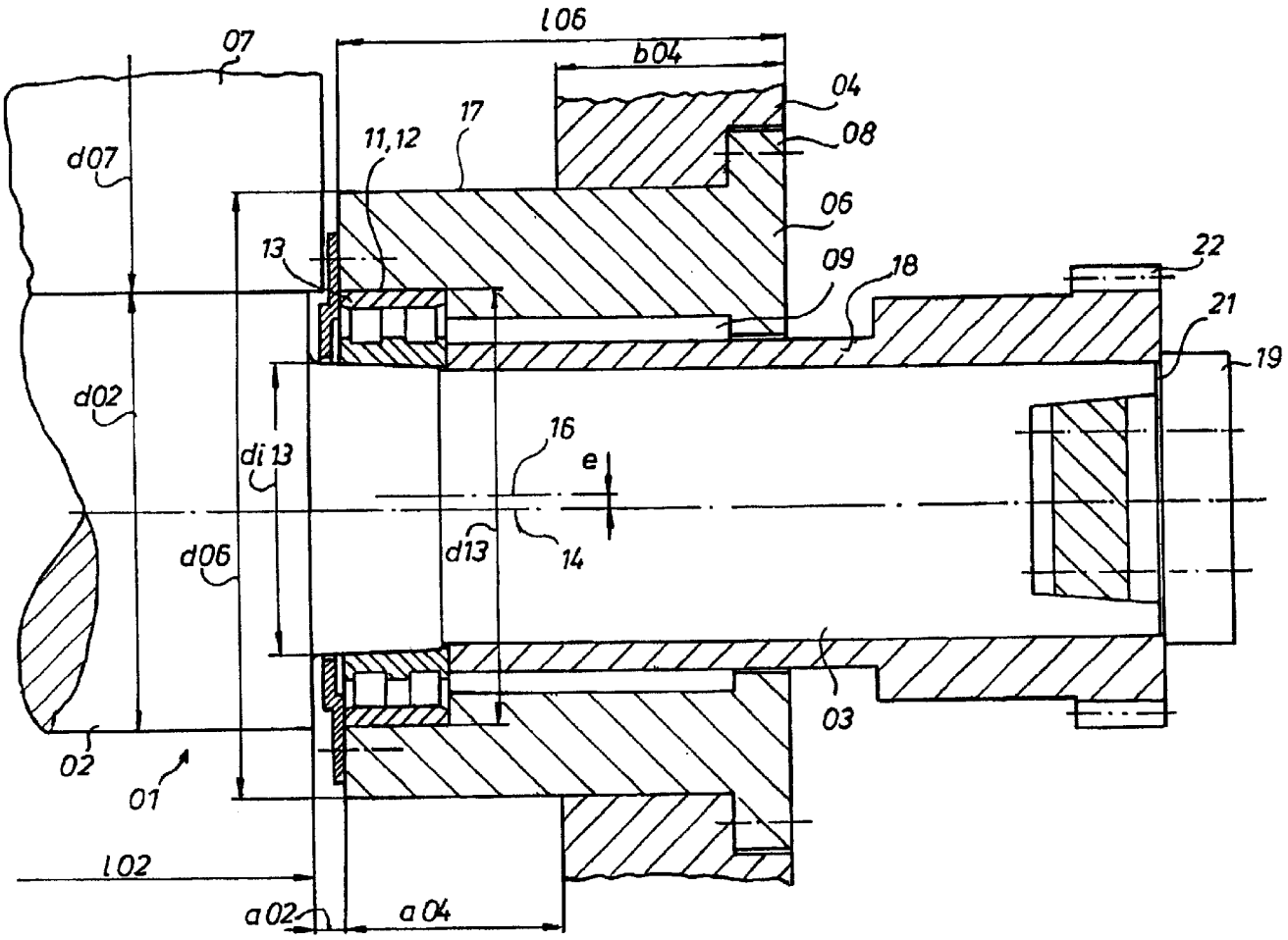
19
22
21
18
04
08
06
09
03
b04
l06
e
16
14
17
d13
11,12
a04
13
di13
a02
07
d06
01
d07
d02
02
l02

ARRANGEMENT OF BEARINGS PERTAINING TO A CYLINDER OF A ROTARY PRINTING PRESS

FIELD OF THE INVENTION

The present invention is directed to the seating of a cylinder of a rotary printing press. The cylinder is supported by a bearing which is located exterior of the press side frame in an intermediate bushing.

BACKGROUND OF THE INVENTION

A seating of an exchangeable cylinder is known from EP 0 714 767 B1. One bearing is arranged in the vicinity of the barrel outside of the lateral frame.

DE 15 61 048 A shows the seating of a forme cylinder. The bearing is located outside of the lateral frame.

U.S. Pat. No. 3,786,749 discloses a bearing with two tapered roller bearings. One of the tapered roller bearings is located inside the lateral frame.

EP 0 734 857 A2 describes a seating for rollers. The bearing is arranged outside of the frame at a distance less than the inner diameter of the bearing.

DE 196 46 135 A1 shows a printing press with cylinders seated on one side, which cylinders are overlaid by bushings. The base body of these cylinders has a lesser diameter than the outer diameters of the bearing bushing.

EP 0 878 299 A1 discloses a newspaper printing press. The plate cylinder of the press has a length-to-diameter ratio of 8.4:1 to 9:1.

SUMMARY OF THE INVENTION

The object of the present invention is directed to providing a seating for a cylinder of a rotary printing press.

In accordance with the present invention, this object is attained by supporting the journal of the cylinder in a bearing which itself is located completely outside of a side frame of the press. The bearing is situated in a bushing that is supported in the side frame. The outer diameter of the bushing is greater than the diameter of the cylinder. The bearing is supported in the bushing at a defined spacing distance from the inner face of the lateral frame.

The advantages which can be realized by the present invention reside, in particular, in that a high degree of rigidity of the seating of the cylinder is achieved by the special arrangement of the bearing. The printing quality is improved by this highly rigid cylinder seating.

The removal of a cylinder is also made easier by the seating, and the setting of the bearing play is simplified.

BRIEF DESCRIPTION OF THE DRAWING

A preferred embodiment of the present invention is represented in the sole drawing FIGURE and will be described in greater detail in what follows.

DESCRIPTION OF THE PREFERRED EMBODIMENT

A cylinder 01 of a rotary printing press has a barrel 02 with a diameter d02, for example d02=150 mm, and is rotatably seated in a lateral frame 04 by a journal 03, as seen in the sole drawing. The lateral frame 04 has a frame width b04 of, for example b04=80 mm, and is provided with a bore in which a bearing bushing 06, for example an eccentric bushing 06, for setting an axial distance of cylinder 01 from an adjoining cylinder 07, is arranged. This bushing 06 has a collar 08 which is received in a chamfer on the outer face of side frame 04. Bushing 06 is secured against being displaced in the axial direction by screws, for example. An interior bore 09 of the bushing 06, on the side of the bushing 06 facing the barrel 02 of the cylinder 01, is provided with a bushing interior shoulder 11. An exterior diameter d06, for example d06 =210 mm, of the bushing 06 and of the bore in the lateral frame 04 is greater than the diameter d02 of the barrel 02 of the cylinder 01. A length 106, for example 106=155 mm, of the bushing 06 is greater than a width b04 of the lateral frame 04, so that the bushing 06 projects past the inner face of the lateral frame 04 in the direction toward the cylinder 01.

A bore 12 for receiving a bearing 13 of an exterior diameter d13, for example d13=150 mm, is provided in the shoulder 11 of the bushing 06. A longitudinal axis 14 of this bore 12 in the bushing 06 for receiving a bearing 13 is offset by an eccentricity e, for example e=5 mm, in respect to the longitudinal axis 16 of the cylindrical outer surface 17 of the bushing 06. A first lateral or inner end surface of the bearing 13 facing the barrel 02 of the cylinder 01 terminates with the inner end of the bushing 06. A second lateral or outer end surface of the bearing 13, facing away from, and spaced from the barrel 02 of the cylinder 01 terminates with the end of the shoulder 11 that is closer to the lateral frame 04. The lateral or inner end surface of the bearing 13; i.e. the bearing surface facing the barrel 02, has a spacing distance a04, for example 04=85 mm, from the inner surface of the lateral frame 04 and is located outside of the lateral frame 04. The distance a04 is greater than 0 mm and is less than the diameter of the journal 03 of the cylinder 01, or then the diameter di13 of the inner ring of the bearing 13, i.e. $0<a04<di13$. At its largest point, the inner ring of the bearing 13 has an interior diameter di13, for example di13=100 mm.

The inner diameter di13 of the bearing 13 is at least half the diameter d02/2 of the cylinder 01, preferably $di13 \geqq 0.6 \geqq d02$.

Preferably, the second lateral or outer end surface of the bearing 13, with respect to the barrel 02, is also located at a distance away from the inner surface of the lateral frame 04, i.e. outside of the lateral frame 04.

The first lateral or inner end face of the bearing 13: i.e. the end facing the barrel 02, is arranged at a distance a02, for example a02=10 mm, from the barrel 02. Preferably, a ratio of the diameter d02 of the barrel 02 to this distance a02 is greater or equal to 15, i.e. $d02/a02 \geqq 15$.

The bearing 13 is preferably a cylindrical roller bearing with a tapering inner ring. The bearing play can be set by displacing the inner ring in the axial direction.

A journal bushing 18, extending through the lateral frame 04, is arranged, displaceable in the axial direction, on the journal 03 of the cylinder 01. A first, inner front face of the journal bushing 18 of the cylinder 01; i.e. the face of bushing 18 facing the barrel 02 of the cylinder 01, acts on the radially inner race of the bearing 13. A setting device 19, for example a disk 19 provided with a centering collar and screwed to a front face of the journal 03, acts on a second or outer front face of the bushing 18; i.e. the face of bushing 18 facing away from the barrel 02 of the cylinder 01. Spacer elements 21 can be arranged between the disk 19 and the front face of the journal 03.

An end of the journal bushing 18 facing away from the barrel 02 is provided with a gear wheel 22 for driving the cylinder 01. It is also possible to provide a second gear wheel, for example for driving an inking or damping unit.

This cylinder 01 is preferably a forme cylinder 01 and preferably acts in cooperation with a transfer cylinder 07. A diameter d07, for example d07=300 mm, of the transfer cylinder 07 preferably is approximately twice the diameter d02 of the forme cylinder 01.

A ratio of a length 102 of the barrel of cylinder 01 to its diameter d02 is 6 to 12, preferably 8.5 to 9.5.

Only one side of the seating or support of the cylinder has been described for the sake of simplicity. The second side of the seating of cylinder 01 is arranged substantially identically, except for the gear wheel 22, but is laterally reversed. The two associated lateral frames 04 here have a spacing distance>1300 mm, for example 1540 mm.

If the seating or support of the cylinder 01 utilizes several bearings 13, the distance a02 is understood to be from a bearing 13 closest to the lateral frame 04. All bearings of this seating for rotating the cylinder 01 are located completely outside of the frame 04. Preferably a single bearing is provided for each side of the cylinder.

While a preferred embodiment of an arrangement of bearings pertaining to a cylinder of a rotary printing press in accordance with the present invention has been set forth fully and completely hereinabove, it will be apparent to one of skill in the art that various changes in, for example, the type of printing press, the type of material being printed and the like could be made without departing from the true spirit and scope of the present invention which is accordingly to be limited only by the following claims.

What is claimed is:

1. A support for a cylinder of a rotary printing press comprising:

a cylinder barrel having a cylinder barrel length and a cylinder barrel diameter and a lateral barrel face and with a cylinder journal extending from said lateral barrel face:

a lateral frame having an inner frame face; and a bearing having a bearing inner diameter, a bearing outer diameter and a bearing length defined by bearing inner and outer end faces, said bearing being arranged completely outside of said lateral frame and receiving said cylinder journal, said bearing inner end face being spaced from said lateral frame inner face by a first distance and at a second distance from an adjacent lateral barrel face wherein said first distance is less than said bearing inner diameter and further wherein a ratio of said cylinder barrel diameter to said second distance is greater than or equal to 15 and wherein a ratio of said cylinder barrel length to said barrel diameter is between 8.5 to 9.5.

2. The support for a cylinder of claim 1 further including a bearing bushing and a bore in said lateral frame with said bearing brushing being supported in said bore and with said bearing being arranged in said bearing bushing, said bearing bushing having an outer diameter which is greater than said cylinder barrel diameter.

3. The support for a cylinder of claim 1 wherein said bearing inner diameter is at least half of said cylinder barrel diameter.

4. The support for a cylinder of claim 1 wherein said cylinder is a forme cylinder.

5. The support for a cylinder of claim 1 wherein said cylinder journal extends past said lateral frame.

6. The support for a cylinder of claim 1 wherein said support includes only one bearing.

7. The support for a cylinder of claim 1 wherein said support includes at least first and second bearings.

8. The support for a cylinder in accordance with claim 7 wherein all of said at least first and second bearing are outside of said lateral frame.

9. A support for a cylinder of a rotary printing press comprising:

a cylinder barrel having a cylinder barrel length and a cylinder barrel diameter and having a lateral barrel face and with a cylinder journal extending from said lateral barrel face;

a lateral frame having an inner face and a bore;

a bearing bushing supported in said lateral frame bore, said bearing bushing having an outer diameter;

a bearing arranged in said bearing bushing and having a bearing inner diameter, said bearing supporting said cylinder journal; and a transfer cylinder supported for engagement with said cylinder barrel in a contact zone, said transfer cylinder having a transfer cylinder diameter and wherein said transfer cylinder diameter is a whole number multiple of said cylinder barrel diameter in said contact zone and further wherein said bearing bushing outer diameter is greater than said cylinder barrel diameter and a ratio of said cylinder barrel length to said cylinder barrel diameter is between 8.5 and 9.5.

10. The support for a cylinder of claim 9 wherein said bearing has a first inner end face, said first inner end face of said bearing being spaced from said lateral frame at a first spacing distance which is less than said inner diameter of said bearing and further wherein said first inner end face of said bearing is spaced from said cylinder barrel face at a second spacing distance, a ratio between said cylinder barrel diameter and said second spacing distance being greater than or equal to 15.

11. The support for a cylinder of claim 9 wherein said bearing inner diameter is at least half of said cylinder barrel diameter.

12. The support for a cylinder of claim 9 wherein said cylinder is a forme cylinder.

13. The support for a cylinder of claim 9 wherein said cylinder journal extends past said lateral frame.

14. The support for a cylinder of claim 9 wherein said support includes only one bearing.

15. The support for a cylinder of claim 9 wherein said support includes at least first and second bearings.

16. The support for a cylinder in accordance with claim 15 wherein all of said at least first and second bearing are outside of said lateral frame.

* * * * *